US005230107A

United States Patent [19]

Alperovich et al.

[11] Patent Number: 5,230,107

[45] Date of Patent: Jul. 27, 1993

[54] MULTIPURPOSE BATH APPARATUS

[76] Inventors: Boris Alperovich, 15 Foxcroft Dr., Marlboro, N.J. 07746; Leonid Vakhovsky, 3848 Nautilus Ave. Apt. 3, Brooklyn, N.Y. 11224

[21] Appl. No.: 835,702

[22] Filed: Feb. 12, 1992

[51] Int. Cl.[5] ..... A47K 3/22

[52] U.S. Cl. ..... 4/567; 4/443; 4/546

[58] Field of Search ..... 4/443, 444, 446, 447, 4/448, 541.1, 541.3, 538, 546, 567, 568, 569, 570, 597

[56] References Cited

U.S. PATENT DOCUMENTS

| | | | |
|---|---|---|---|
| 263,592 | 8/1882 | Rosenfield | 4/569 |
| 663,826 | 12/1900 | Baker | 4/447 |
| 963,812 | 7/1910 | Sandham | 4/568 |
| 2,589,281 | 3/1952 | Ocana | 4/447 |
| 3,947,898 | 4/1976 | Ducharme | 4/447 |
| 4,123,808 | 11/1978 | Guarrera | 4/447 |
| 4,424,598 | 1/1984 | Cima | 4/597 X |

FOREIGN PATENT DOCUMENTS

| | | | |
|---|---|---|---|
| 0100035 | 6/1988 | Japan | 4/541.3 |
| 0105590 | 4/1917 | United Kingdom | 4/541.3 |

*Primary Examiner*—William A. Cuchlinski, Jr.
*Assistant Examiner*—W. Morris Worth
*Attorney, Agent, or Firm*—Charles I. Brodsky

[57] ABSTRACT

A portable bidet seat is described as being supported by one side of a bathtub enclosure and by a first pipe secured to a wall adjacent to an opposite side of the enclosure. A pair of additional pipes traverse within the first pipe, one of which is coupled to direct a tap water flow from the bathtub faucet to the bidet unit. The other pipe of the pair couples to a whirlpool system for the bathtub. In a further embodiment of the invention, the first pipe may also be coupled to the faucet and be perforated to provide a sideways directed shower flow for the tub user.

10 Claims, 2 Drawing Sheets

MULTIPURPOSE BATH APPARATUS

FIELD OF THE INVENTION

This invention relates to a multipurpose bath apparatus, in general, and to one which is removably securable in use, in particular.

BACKGROUND OF THE INVENTION

As is well known and understood, with an increased immigration into the U.S.—or into any new country for that matter—comes an inflow of ideas, needs and desirabilities which attach to and accompany the immigrant. Thus, in recent years, there has come to be a recondition that bidets, oftentimes found in European countries, exhibit features just beginning to be realized by U.S. residents. However, as is also well known and understood, modernization of bath facilities is not an inexpensive matter, and revisions of bathtub facilities can be quite onerous. At the same time, even in the U.S., more and more people have come to appreciate the advent of the modern-day whirlpool systems—but they, too, cannot merely be incorporated into an existing enclosure, but generally require a replacement of the entire tub system, along with its attendant cost.

SUMMARY OF THE INVENTION

As will become clear from the following description, the present invention encompasses a multipurpose bath apparatus which removably secures a combination bidet-whirlpool system in an existing tub environment. As will be seen, a portable bidet seat is first incorporated as being supported by one side of a bathtub enclosure, and by a first pipe secured to a wall adjacent to an opposite side of the enclosure. A pair of additional pipes transverse within the first pipe, according to the invention, one of which is coupled to direct a tap water flow from the bathtub faucet to the bidet unit. The other pipe of the pair, in accordance with the described teachings, couples to a whirlpool system for the bathtub. In a further embodiment of the invention, the first pipe may also be coupled to the faucet, and be perforated to provide a sideways directed shower for the tub user—all for the purpose of providing multiple purposes according to the dictates and desires of the user. As will also be seen from the description that follows, each of the bidet, whirlpool and sideshower functions are accomplished through the use of flexible tubing, or hosing, which can all be removably coupled either to the tub faucet or the various intake and exhaust ports of the pipes employed, so as to enable the apparatus to be easily and simply installed, or removed, as the case may be. In further accordance with the invention, the first pipe—which is secured to a structural wall adjacent to the tub, also serves as a means of support in getting into, or out from, the tub enclosure in use. As will further be seen, a reservoir or tank, containing cleansers, therapeutic agents, or other fragrant ingredients, as an example, may be coupled into the pipes or tubings employed, as desired, to add other features usable with the invention as set forth.

BRIEF DESCRIPTION OF THE DRAWING

These and other features of the present invention will be more fully understood from a consideration of the following description, taken in connection with the accompanying drawing, in which.

DETAILED DESCRIPTION OF THE DRAWING

Figure 1:
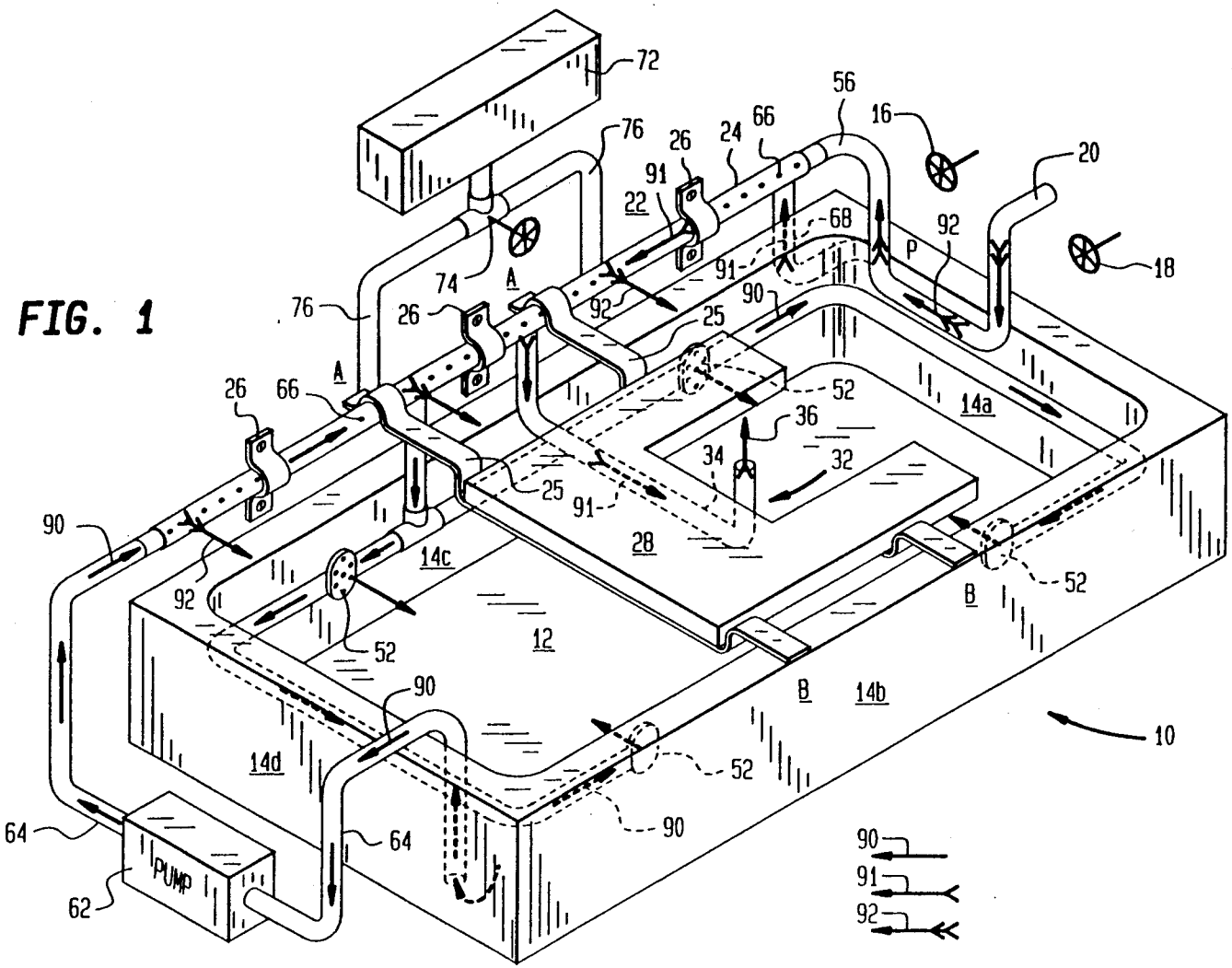
FIG. 1 is a perspective view of the multipurpose bath apparatus of the present invention.
Figure 2:
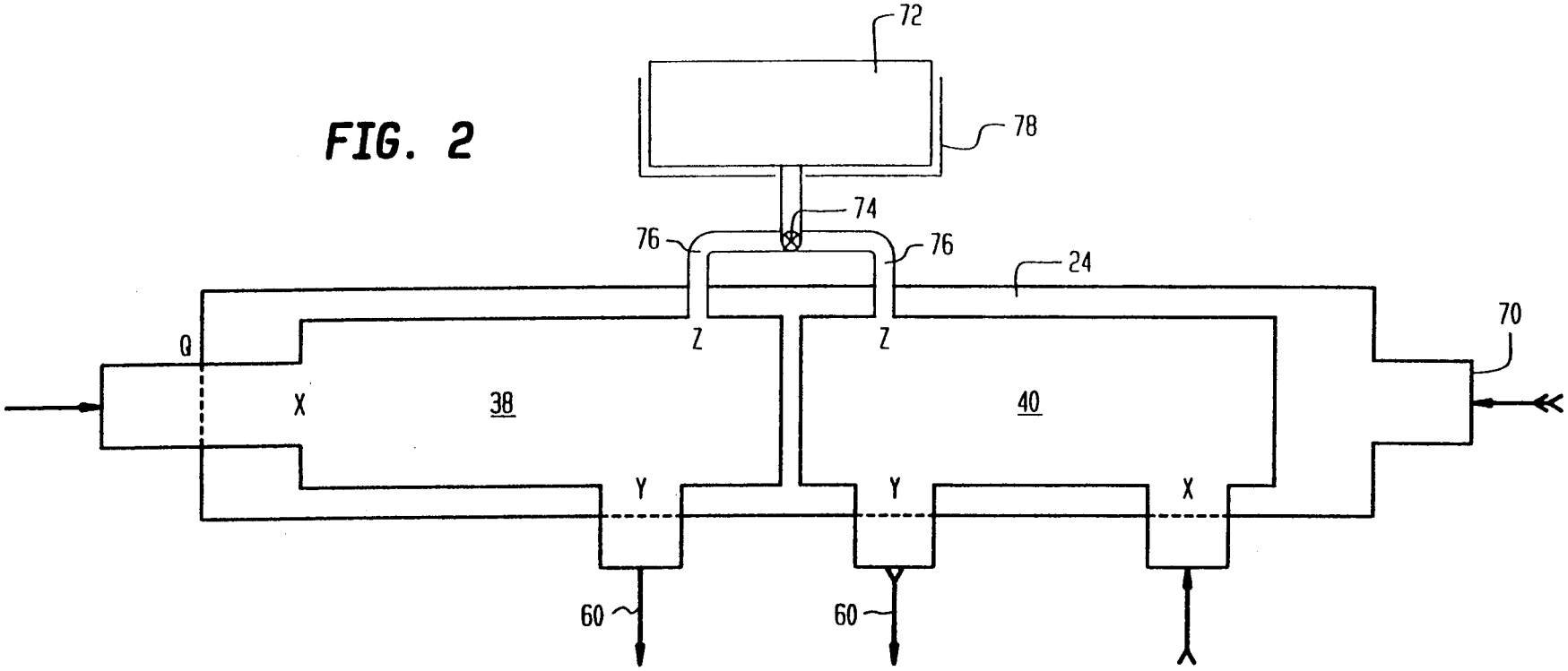
FIG. 2 is a schematic representation helpful in an understanding of its use and operation.

In FIGS. 1 and 2, reference numeral 10 represents the bathtub, or bath receptacle of the invention, defined by a planar bottom 12 and sides 14*a*, 14*b*, 14*c* and 14*d*. As will be seen, side 14*a* lies adjacent to a source of tap water for the receptacle, shown by the faucets 16 (hot) and 18 (cold), combining into a single spigot 20. As is also shown, the side 14*c* of receptacle 10 will be understood as being situated adjacent to a structural wall 22—although in actual use, where the individual components employed are rigid and strong enough, the apparatus may also be freestanding. In the usual situation though, the apparatus is employed in association with a separate room where a wall 22 is available—and to such end, a first pipe 24 is employed, secured to the wall 22 in any appropriate manner, as by the clamps 26 through which screws, or other fasteners, pass in securement to the wall 22.

In accordance with the present invention, a bidet seat 28 is also utilized, and of any appropriate design. As shown, the seat 28 is secured with a series of support arms 25, so as to comfortably seat atop the pipe 24 at the area A and at the area B by the side 14*b* of the receptacle 10. As will be appreciated, an aperture, or other arrangement, is incorporated as part of the underside of the seat 28—as at 32—to receive a first length of flexible tubing or hosing 34 coupled in any appropriate manner to the pipe 40, and so as to provide an upward flow of water at the underside of the seat 28, as indicated by the reference arrow notation 36.

More particularly, and as shown in FIG. 2, the pipe 24 is shown as surrounding a pair of additional pipes 38, 40. As illustrated, each such pipe has an intake port X and an exhaust port Y extending out of openings in pipe 24, and also has an input port Z. Coupled to the port Y of the pipe 38 is a first water distribution system 60, which traverses the interior of the bath receptacle 10, along the inner surfaces of the walls 14*a*, 14*b*, 14*c* and 14*d*, in the nature of flexible tubing or hosing, along with a plurality of jet nozzles 52 for inwardly directing sprays of water into the tub, as indicated at the respective nozzle locations. In similar manner, a second water distribution system 60 couples to the exhaust port Y of the pipe 40, as previously described as the tubing 34 leading to the upwardly directed water flow at 36.

In accordance with the invention, the intake port X of the pipe 40 is coupled by a further flexible tubing or hosing 56 to the faucet spigot 20 in providing a mixture of the hot and cold water from the faucet through the pipe 40 in directing the upward flow at the bidet seat 28.

Also, according to the invention, a second set of flexible tubing, or hosing, is coupled to the intake port X of the pipe 38, to an appropriately powered pump 62 and further flexible tubing or hosing 64 to lead to a point just adjacent to the planar bottom 12 of the bath receptacle 10 at which water accumulates in the receptacle during use. With a ¾ self prime horsepower pump, for example, it will be appreciated that a recirculation of the water in the tub occurs through this network of tubing 64, to provide a whirlpool type action in the tub by means of the jet nozzles 52.

Thus, and as so far described, the multipurpose bath receptacle apparatus of the invention will be seen to operate to provide both a bidet-type function, and a whirlpool-type function—which, when appropriate "speed-type" couplers are employed, can be removably secured to operate with the bath enclosure 10. However, and also in accordance with the invention, the pipe 24 is also provided with a series of perforations, as at 66, running along the length of the pipe 24, in a direction facing inwardly of the receptacle 10, and wherein a further tubing or hosing 68 is employed to couple the faucet spigot 20 to the intake port of the pipe 24, shown as 70. As will be appreciated, to utilize these perforations 66 in providing a side-shower feature to the apparatus described, a pair of water couplings to the intake port 70 of the pipe 24 is required, along with a coupling to the intake port X of the pipe 40—and will be appreciated as being represented by the "dotted" nature of the tubing from the point P. As will also be appreciated, so as to allow this "side-shower" operation to occur, the remote end of the pipe 24, must be closed-off, as at "Q", which is not otherwise necessary if all that the pipe 24 were utilized for was to support the bidet seat 28 and enclose the traversing pipes 38, 40 in providing the whirlpool and "bidet" operations, respectively.

As is also shown in FIGS. 1 and 2, a reservoir, or tank, is also shown, and understood to contain therein any one of a number of cleansing, therapeutic, fragrant ingredients as may be desired in adding to the scope of the functions afforded by the described apparatus. As shown, the reservoir 72 is coupled by means of a valve 74, and associated further tubing or hosing 76 to the input ports "Z" of the pipes 38 and 40. As will be readily understood, merely rotating the valve 74 one way or the other—or closing it off completely in any appropriate manner—any of the ingredients or formulations contained in the reservoir 72 can be mixed, or added to, the liquid flow traversing through the pipe 38 in providing the whirlpool operation, or through the pipe 40 in providing the bidet operation. As will be apparent, such mixing or adding of ingredients is independent of the operation of the "side-shower" function affordable with the described apparatus. Where the described components are utilized with a structural wall where the clamps 26 are secured, then it will be apparent that the tank or reservoir 72 could similarly be so secured, and refillable as desired. Where the tub receptacle, or enclosure, 10 is freestanding, on the other hand, in an arrangement where the strength and rigidity of the pipe 24 is sufficient to support the water distribution systems described, it will be equally apparent that a frame 78 could also be utilized to support the weight of the tank, or reservoir 72, without any need for it being secured to a structural wall. In one specific embodiment envisioned for the invention, successful operation was had utilizing a pump 62 of ¾ horsepower, as described above, and with flexible plastic hose as the tubing described in providing the various functions set forth. Clearly, to those skilled in the art, modifications of these components can be had, and the operation continue essentially unchanged.

(To facilitate an understanding of the invention, the arrow notation 90 illustrates the fluid flow for the whirlpool operation of the invention, the single-tail notation 91 illustrates the fluid flow for the bidet operation, and the double-tail notation 92 illustrates that for the side shower operation of the invention.)

While there have been described what are considered to be preferred embodiments of the present invention, it will be appreciated by those skilled in the art that other modifications can be made without departing from the scope of the teachings herein. For at least such reason, therefore, resort should be had to the claims appended hereto for a true understanding of the scope of the invention.

We claim:

1. Multipurpose bath apparatus comprising:

a bath receptacle having a planar bottom and opposite defining sides;

a first pipe having an inlet end and a closed end, said pipe running generally parallel to and along one side of said receptacle;

a seat supported across said receptacle by said first pipe and by the side of said receptacle opposite said first side;

second and third pipes within said first pipe, each having their own intake and exhaust ports extending out of said first pipe;

a first water distribution system coupled to the exhaust port of said second pipe, traversing the interior of said receptacle, and including a plurality of jet nozzles for inwardly directing sprays of water into said receptacle;

a second water distribution system, including a further nozzle, coupled to the exhaust port of said third pipe for directing an upward flow of water at an underside area of said seat;

first means coupling the intake port of said third pipe to a water faucet for said bath receptacle;

second means, including a pump, coupling the intake port of said second pipe to a point adjacent the planar bottom of said bath receptacle, at which water accumulates in said receptacle during use;

wherein said first pipe is perforated along its length in a direction facing said bath receptacle;

and wherein there is also included third means coupling said inlet end of said first pipe to said water faucet for said receptacle.

2. The apparatus of claim 1 wherein each of said second and third pipes incorporates an input port, and wherein there is also included fourth means coupled to at least one of said input ports for adding one of a cleansing, therapeutic and fragrant ingredient to the flowing in one of said second and third pipes.

3. The apparatus of claim 1 wherein said first water distribution system is removably coupled to the exhaust port of said second pipe.

4. The apparatus of claim 1 wherein said second water distribution system is removably coupled to the exhaust port of said third pipe.

5. The apparatus of claim 1 wherein said first means is removably coupled to the intake port of said third pipe.

6. The apparatus of claim 1 wherein said second means is removably coupled to the intake port of said second pipe.

7. The apparatus of claim 1 wherein said third means is removably secured to said one end of said first pipe.

8. The apparatus of claim 1 wherein said first pipe is fixedly secured to a structural wall situated adjacent to said one side of said bath receptacle.

9. The apparatus of claim 1 wherein said first pipe is fixedly secured to a structural wall situated adjacent to said one side of said bath receptacle, wherein said first water distribution system is removably coupled to the exhaust port of said second pipe, wherein said second water distribution system is removably coupled to the exhaust port of said third pipe, wherein said first means is removably coupled to the intake port of said third pipe, wherein said second means is removably coupled to the intake port of said second pipe, wherein said third means is removably secured to said inlet end of said first pipe, and wherein said first and second water distribution systems, and said first, second and third coupling means all include lengths of flexible hosing.

10. The apparatus of claim 9 wherein each of said second and third pipes incorporates an input port, and wherein there is also included fourth means coupled to at least one of said input ports for adding one of a cleansing, therapeutic and fragrant ingredient to the water flowing in one of said second and third pipes.

* * * * *